US011959029B2

(12) United States Patent
Carp et al.

(10) Patent No.: US 11,959,029 B2
(45) Date of Patent: Apr. 16, 2024

(54) INTEGRATED PROCESS FOR THE CONVERSION OF CRUDE TO OLEFINS

(71) Applicant: UOP LLC, Des Plaines, IL (US)

(72) Inventors: Stanley S. Carp, New Lenox, IL (US); David Banks, Arlington Heights, IL (US); Alan K. Bedell, Durango, CO (US); Gregory Funk, Carol Stream, IL (US); Keith Allen Couch, Arlington Heights, IL (US); Stanley Joseph Frey, Palatine, IL (US); Cora Wang Ploentham, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 18/067,777

(22) Filed: Dec. 19, 2022

(65) Prior Publication Data

US 2023/0212464 A1 Jul. 6, 2023

Related U.S. Application Data

(60) Provisional application No. 63/295,768, filed on Dec. 31, 2021.

(51) Int. Cl.

| | |
|---|---|
| ***C10G 63/06*** | (2006.01) |
| ***C10G 9/36*** | (2006.01) |
| ***C10G 35/02*** | (2006.01) |
| ***C10G 45/44*** | (2006.01) |
| ***C10G 45/58*** | (2006.01) |

(Continued)

(52) U.S. Cl.

CPC ..... *C10G 63/08* (2013.01); *C10G 9/36* (2013.01); *C10G 35/02* (2013.01); *C10G 45/44* (2013.01); *C10G 45/58* (2013.01); *C10G 63/04* (2013.01); *C10G 70/041* (2013.01); *C10G 2300/1033* (2013.01); *C10G 2300/4025* (2013.01);

(Continued)

(58) Field of Classification Search

CPC ..... C10G 63/08; C10G 9/36; C10G 35/02; C10G 45/44; C10G 45/58; C10G 63/04; C10G 70/041; C10G 2300/1033; C10G 2300/4025; C10G 2300/4081; C10G 2400/20; C10G 2400/30; C10G 9/00; C10G 29/205; C10G 35/04; C10G 69/00; C10G 69/06; C10G 69/08

USPC ..... 208/69

See application file for complete search history.

(56) References Cited

U.S. PATENT DOCUMENTS

| | | | | |
|---|---|---|---|---|
| 2014/0171704 | A1 | 6/2014 | Erisken | |
| 2014/0221715 | A1* | 8/2014 | Bridges | C10G 63/04 422/187 |

(Continued)

OTHER PUBLICATIONS

Search Report and Written Opinion for PCT/US2022/082471 dated May 9, 2023.

*Primary Examiner* — Prem C Singh
*Assistant Examiner* — Francis C Campanell
(74) *Attorney, Agent, or Firm* — Paschall & Associates LLC; James C. Paschall

(57) ABSTRACT

A process for producing light olefins comprising thermal cracking. Hydrocracked streams are thermally cracked in a steam cracker to produce light olefins. A pyrolysis gas stream is separated into a light stream and a heavy stream. A light stream is separated into an aromatic naphtha stream and a non-aromatic naphtha stream. The aromatics can be saturated and thermally cracked. The integrated process may be employed to obtain olefin products of high value from a crude stream.

19 Claims, 2 Drawing Sheets

(51) Int. Cl.

| | |
|---|---|
| ***C10G 63/04*** | (2006.01) |
| ***C10G 63/08*** | (2006.01) |
| ***C10G 70/04*** | (2006.01) |

(52) U.S. Cl.
CPC . *C10G 2300/4081* (2013.01); *C10G 2400/20* (2013.01); *C10G 2400/30* (2013.01)

(56) References Cited

U.S. PATENT DOCUMENTS

| | | | |
|---|---|---|---|
| 2019/0337869 | A1 | 11/2019 | Erisken et al. |
| 2020/0115645 | A1 | 4/2020 | Al-Ghamdi et al. |
| 2021/0277316 | A1 | 9/2021 | Funk et al. |

* cited by examiner

INTEGRATED PROCESS FOR THE CONVERSION OF CRUDE TO OLEFINS

CROSS REFERENCE TO RELATED APPLICATION

This application claims priority from U.S. Provisional Application No. 63/295,768 filed Dec. 31, 2021, the contents of which are hereby incorporated by reference.

FIELD

The field is the production of olefins by pyrolysis. Particularly, the field is the production of olefins and aromatics from crude oil.

BACKGROUND

Light olefin production is vital to the production of sufficient plastics to meet worldwide demand. Ethylene and propylene are important chemicals for use in the production of other useful materials, such as polyethylene and polypropylene. Polyethylene and polypropylene are two of the most common plastics found in use today and have a wide variety of uses. Uses for ethylene and propylene include the production of vinyl chloride, ethylene oxide, ethylbenzene, cumene, polyols and alcohol.

Paraffin dehydrogenation (PDH) is a process in which light paraffins such as ethane, propane, and butane can be dehydrogenated to make ethylene, propylene, and butene respectively. Dehydrogenation is an endothermic reaction which requires external heat to drive the reaction to completion.

The great bulk of the ethylene consumed in the production of the plastics and petrochemicals such as polyethylene is produced by the thermal cracking of hydrocarbons. Steam is usually mixed with the feed stream to the cracking furnace to reduce the hydrocarbon partial pressure and enhance olefin yield and to reduce the formation and deposition of carbonaceous material in the cracking reactors. The process is therefore often referred to a steam cracking or pyrolysis.

Steam cracking generates less valuable by-products such as pyrolysis gasoline (pygas) and fuel oil (pyoil). Pygas contains large proportions of paraffins and aromatics. The resulting paraffins include normal and non-normal paraffins which can be recovered or further processed. Aromatics are very stable and difficult to crack in a steam cracker. The paraffinic side chains can be removed, but this leads to the production of multi-ring aromatics which increases the yield of low-value fuel oil. Normal paraffins more selectively pyrolyze to olefins than non-normal paraffins.

The combination of processes often leads to high economic cost. Thus, there is a need for improved processes for preparing crude materials for steam cracking to light olefins and a means for managing the wealth of pyrolyzed products from a steam cracking unit to improve light olefin yield.

BRIEF SUMMARY

We have found that integrating thermal cracking with additional process units in a combined process for conversion of crude oil produces a high yield of light olefins and aromatics. Pyrolysis gas from a steam cracker can be hydrotreated and split, perhaps with a reformate stream, and subjected to aromatic separation to produce additional steam cracker feed.

In a further embodiment, remaining aromatics from the pyrolysis gas may be saturated. The resulting C6-C8 naphthene makes excellent feed to a steam cracking unit by way of recycle and the C5-C6 naphtha may be isomerized and cracked to produce more normal paraffins which are also an excellent steam cracking feed or paraffin dehydrogenation (PDH) feed.

Hence, crude streams can be prepared to make steam cracker feed with an avenue for recycling aromatics produced from steam cracking back to the steam cracker after processing.

In a further embodiment, crude distillate streams may also be hydrocracked to make steam cracker feed.

DEFINITIONS

Figure 1:
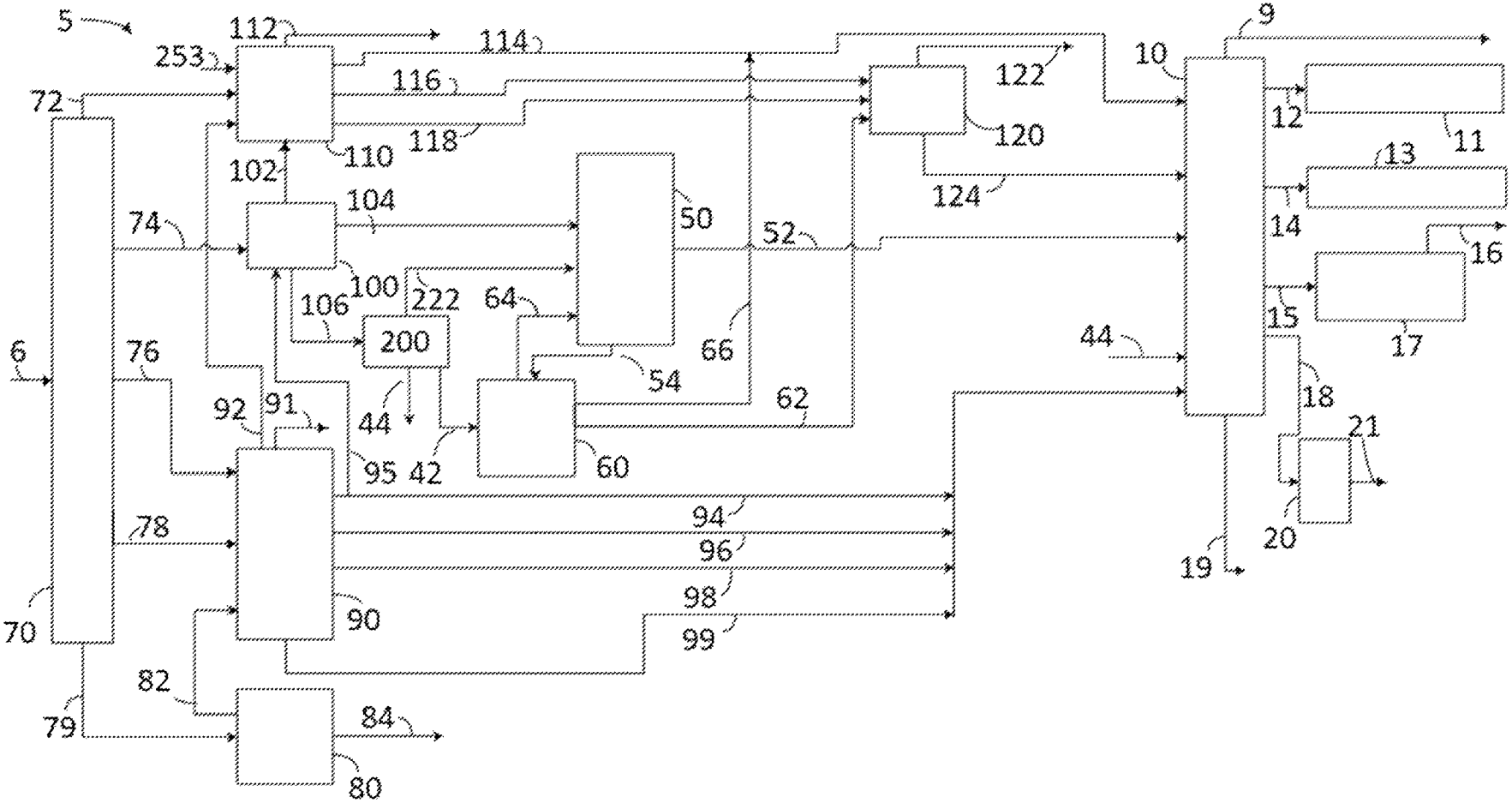
FIG. 1 is a schematic drawing of an overall process of the present disclosure.

The term "communication" means that fluid flow is operatively permitted between enumerated components, which may be characterized as "fluid communication".

The term "downstream communication" means that at least a portion of fluid flowing to the subject in downstream communication may operatively flow from the object with which it fluidly communicates.

The term "upstream communication" means that at least a portion of the fluid flowing from the subject in upstream communication may operatively flow to the object with which it fluidly communicates.

The term "direct communication" means that fluid flow from the upstream component enters the downstream component without passing through any other intervening vessel.

The term "indirect communication" means that fluid flow from the upstream component enters the downstream component after passing through an intervening vessel.

The term "bypass" means that the object is out of downstream communication with a bypassing subject at least to the extent of bypassing.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripper columns may omit a reboiler at a bottom of the column and instead provide heating requirements and separation impetus from a fluidized inert media such as steam. Stripping columns typically feed a top tray and take main product from the bottom.

As used herein, the term "a component-rich stream" or "a stream rich in a component" means that the rich stream coming out of a vessel has a greater concentration of the component than any other stream from the vessel.

As used herein, the term "a component-lean stream" or "a stream lean in a component" means that the lean stream coming out of a vessel has a smaller concentration of the component than any other stream from the vessel.

As used herein, the term "T5", "T95" or "TX" means the temperature at which 5 mass percent, 95 mass percent or X mass percent, as the case may be, respectively, of the sample boils using ASTM D-86 or TBP.

As used herein, the term "initial boiling point" (IBP) means the temperature at which the sample begins to boil using ASTM D-7169, ASTM D-86 or TBP, as the case may be.

As used herein, the term "end point" (EP) means the temperature at which the sample has all boiled off using ASTM D-7169, ASTM D-86 or TBP, as the case may be.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

As used herein, the term "predominant" or "predominate" means greater than 50%, suitably greater than 75% and preferably greater than 90%.

The term "Cx" is to be understood to refer to molecules having the number of carbon atoms represented by the subscript "x". Similarly, the term "Cx-" refers to molecules that contain less than or equal to x and preferably x and less carbon atoms. The term "Cx+" refers to molecules with more than or equal to x and preferably x and more carbon atoms.

The term "unit" is to be understood to refer to one or more process steps comprising a chemical transformation. At the heart of a unit is one or more catalytic reactors or separation vessels necessary to accomplish the transformation. A unit may further comprise additional separation vessels including fractionation column(s) to separate product streams. A unit may further comprise pretreatment steps for the chemical transformation. Taken together, "unit" comprises one or more reactors or separation vessels and separation steps and pretreatment steps, whether or not shown in the diagram or explicitly discussed in the specification.

DETAILED DESCRIPTION

The disclosure provides a process for the integration of multiple processes, allowing the transformation of crude oil to multiple products with high olefin yield. The most highly integrated refining facilities in the world currently produce approximately 15% of their net product slate as petrochemicals. The world going forward needs to produce a much higher percentage of petrochemicals to meet anticipated demand. The present disclosure enables petrochemical yield percentages of greater than 60% or greater than 75%, even up to 100% at world scale levels of production. Furthermore, refiners are no longer constrained to a traditional approximately 1:1 ratio of aromatics to olefins in the petrochemical product slate. This disclosure has the flexibility to drive up to 100% net olefins yield while maintaining bankable economics due to a particular combination or combinations of process units with a steam cracking unit. Normal paraffins yield more light olefins in a steam cracking unit. Hence, it is desired to increase the concentration of normal paraffins in the feed stream. Normal molecules are defined to mean straight chain molecules such as normal butane, normal hexane, and normal pentane.

In an exemplary embodiment, crude oil is fed to the crude distillation unit 70. The process and apparatus 5 for refining a crude oil stream to olefins is shown in FIG. 1. Crude oil line 6 from a source may comprise all or part of a crude feed stream recovered from a well. The crude oil stream may be a heavy hydrocarbon stream comprising heavy oil or bitumen. Whole bitumen may include resins and asphaltenes, which are complex polynuclear hydrocarbons, which add to the viscosity of the crude oil and increase the pour point. Crude feed may also include conventional crude oil, coal oils, residual oils, tar sands, shale oil, condensates, deasphalted oil and asphaltic fractions.

The American Petroleum Institute gravity (API gravity) scale is often used to understand density of petroleum streams. The crude oil stream in line 6 typically has an API gravity of between about 20 and about 40 API. The present process may be particularly suited for high API crude feeds such as greater than 30 API or greater than 31 API. Waxy crude oil streams typically have a higher API in excess of 25, but a pour point of between about 20 and 50° C. The viscosity of the crude oil stream may be between about 1 and about 20,000 cSt at about 40° C. Crude oil may have a boiling point range in which about 40 to about 70 vol % of the stream boils at 343° C. (650° F.). The crude oil stream in crude line 6 may typically be subjected to heating and separation of an oil phase from a water phase to dewater the crude oil stream prior to fractionation.

The crude oil stream in line 6 may be heated in a fired heater before it is fed to the crude distillation column 70. In the crude distillation column, the heated crude oil stream is fractionated to provide an overhead light gas stream in an overhead line 72, a light distillate stream in a net overhead liquid line 74, a middle distillate stream in a first side line 76, a gas oil distillate stream in a second side line 78 and an atmospheric bottoms stream in a bottoms line 79. The crude distillation column overhead pressure may be slightly above atmospheric pressure and the bottoms temperature may be between about 340 and about 375° C. The middle distillate stream in the first side line 76 and the gas oil distillate stream in the second side line 78 may be fed to a hydrocracking unit 90.

The distilled overhead light gas stream in line 72 may be fed to a saturated gas plant unit 110. The saturated gas plant unit accepts gas streams from distillation units and other process units around the refinery for further separation into constituent gasses. The saturated gas plant unit 110 is fed streams comprising C1-C4 hydrocarbons and/or H2 with less than 10% olefin content. Typically, feed streams to the saturated gas plant unit 110 may be fed to an absorber-deethanizer where C2 and lighter crude fractions are separated from heavier fractions by lean oil absorption. The deethanizer overhead may be further separated into a C2 stream and an overhead stream comprising C1 and H2 and removed for use as fuel gas or petrochemical feed. Heavier fractions may be stripped and sent to a debutanizer, and lean oil may be recycled back to the absorber-deethanizer. C3 and/or C4 crude fractions may be separated from pentanes in the debutanizer, scrubbed to remove hydrogen sulfide, and fed to a splitter where propane and butane are separated. The saturated gas plant unit comprises a plurality of separation systems such as distillation columns to separate the combined saturated gas feed stream into a plurality of product streams including the saturated gas C1 stream in line 112, saturated gas C2 stream in line 114, saturated gas C3 stream in line 116 and the saturated gas C4 stream in line 118.

A stream predominantly comprising propane and/or butane may be fed to a paraffin dehydrogenation unit 120.

An exemplary propane stream may be the saturated gas C3 stream in line 116. An exemplary butane stream may be the saturated gas C4 stream in line 118. The paraffin dehydrogenation unit comprises passing a preheated feed stream or feed streams to a dehydrogenation reactor. The feed stream (s) is contacted with a dehydrogenation catalyst in the dehydrogenation reactor at dehydrogenation conditions, thereby generating a product stream comprising at least one olefin.

The paraffin dehydrogenation unit 120 will contain a reaction zone comprising one or more reactors. The effluent of the reaction zone may be cooled, compressed and then recooled to condense most of its C3 and/or C4 hydrocarbons to thereby form a hydrogen-rich gas which is recirculated within the dehydrogenation zone to supply the desired hydrogen to hydrocarbon ratio within the reaction zone. It is preferred that the resulting liquid phase is then passed into a fractionation column operated as a deethanizer to produce a C3+ dehydrogenation zone effluent stream in line 124 and a light gas stream in line 122. This light gas stream in line 122 will contain hydrogen and dehydrogenation by-products such as C1 and C2 hydrocarbons and may be fed back to the saturated gas plant unit 110 or to a hydrogen header or a pressure swing adsorption unit to purify a hydrogen stream for provision to the hydrogen header. The dehydrogenation zone effluent stream in line 124 may predominantly comprise ethylene, propylene and/or butenes. The dehydrogenation zone effluent stream in line 124 may bypass the steam cracking furnace and be combined with the pyrolysis product in the steam cracking unit and be separated into the ethylene cracked stream in line 12, the propylene cracked stream in line 14 and/or the butene cracked stream in line 15 or other streams in steam cracking unit 10 for recovery and further treatment or used to produce plastics or other petrochemicals by processes such as polymerization. The paraffin dehydrogenation unit 120 may be in upstream and downstream communication with the saturated gas plant unit 110.

While many reactor types have been used for paraffin dehydrogenation and are contemplated here, the reaction zone of the dehydrogenation zone preferably comprises at least one radial flow reactor in which the catalyst gradually moves downward by gravity flow to allow the continuous replacement of used catalyst with catalyst having a higher activity.

The particular dehydrogenation conditions employed within the reaction zone will vary depending on such factors as the feed stream(s), catalyst activity, and the desired conversion. The conditions which may be employed for paraffin dehydrogenation include a temperature of from about 500° C. to 800° C., a pressure of from about 0.5 to about 20 atmospheres and a liquid hourly space velocity of about 0.5 to 20 $hr^{-1}$. Preferred propane dehydrogenation conditions are a temperature of from about 600° C. to 700° C., a pressure of 1.0 to 3.0 atmospheres, a liquid hourly space velocity of about 1 to 8 $hr^{-1}$ and a hydrogen to total hydrocarbon ratio between 1.0:1.0 and 5.0:1.0.

Many dehydrogenation catalysts have been described and are contemplated here. The preferred propane dehydrogenation catalyst is comprised of a platinum group component, a tin component and an alkali metal component with porous inorganic carrier material. Other catalytic compositions may be used within this zone if desired.

It is preferred that the porous carrier material of the dehydrogenation catalyst is an absorptive high surface area support having a surface area of about 25 to about 500 m.sup.2/g. The porous carrier material should be relatively refractory to the conditions utilized in the reaction zone and may be chosen from those carrier materials which have traditionally been utilized in dual-function hydrocarbon conversion catalysts. A porous carrier material may therefore be chosen from an activated carbon, coke or charcoal, silica or silica gel, clays and silicates including those synthetically prepared and naturally occurring, which may or may not be acid-treated, as for example attapulgus clay, diatomaceous earth, kieselguhr, bauxite; refractory inorganic oxides such as alumina, titanium dioxide, zirconium dioxides, magnesia, silica-alumina, alumina-boria, etc.; crystalline aluminosilicates such as naturally occurring or synthetically prepared mordenite or a combination of one or more of these materials. The preferred porous carrier material is a refractory inorganic oxide, with the best results being obtained with an alumina carrier material. The crystalline aluminas, such as gamma-alumina, give the best results. In general, the preferred dehydrogenation catalysts will have a gamma-alumina carrier which is in the form of spherical particles having a relatively small diameter on the order of about 1/16-inch.

The distilled crude naphtha stream in line 74 may be fed to a naphtha hydrotreating unit (NHT) 100. Hydrotreating is a hydroprocessing process used to remove heteroatoms such as sulfur and nitrogen from hydrocarbon streams, to partially or completely saturate a proportion of the aromatic compounds to meet fuel specifications and to saturate olefinic compounds to meet fuel specifications. The distilled naphtha stream in line 74 may be mixed with hydrogen, heated and charged to the hydrotreating reactor. The hydrotreating reactor may be a fixed bed reactor that comprises one or more vessels, single or multiple beds of catalyst in each vessel, and various combinations of hydrotreating catalyst in one or more vessels. The hydrotreating reactor may provide conversion per pass of about 10 to about 40 vol %. The hydrotreating reactor may comprise a guard bed of specialized material for pressure drop mitigation followed by one or more beds of higher quality hydrotreating catalyst. The guard bed filters particulates and picks up contaminants in the hydrocarbon feed stream such as metals like nickel, vanadium, silicon and arsenic which deactivate the catalyst. The guard bed may comprise material similar to the hydrotreating catalyst. Supplemental hydrogen may be added at an interstage location between catalyst beds in the hydrotreating reactor.

Suitable hydrotreating catalysts are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts. More than one type of hydrotreating catalyst be used in the same hydrotreating reactor. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Preferred hydrotreating reaction conditions include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.8 MPa (gauge) (400 psig) to about 17.5 MPa (gauge) (2500 psig), a liquid hourly space velocity of the fresh hydrocarbonaceous feedstock from about 0.1 $hr^{-1}$, suitably 0.5 $hr^{-1}$, to about 5 $hr^{-1}$, preferably from about 1.5 to about 4 $hr^{-1}$, and a hydrogen rate of about 84 $Nm^3/m^3$ (500 scf/bbl), to about 1,011 $Nm^3/m^3$ oil (6,000 scf/bbl), preferably about 168 $Nm^3/m^3$ oil (1,000 scf/bbl) to about 1,250 $Nm^3/m^3$ oil (7,500 scf/bbl), with a hydrotreating catalyst or a combination of hydrotreating catalysts.

The distilled naphtha stream in the side line 74 may be hydrotreated with hydrogen over the hydrotreating catalyst in the hydrotreating reactor to provide a hydrotreated naphtha stream. The hydrotreated naphtha stream may be separated and fractionated in a naphtha splitter column to provide a C4– overhead stream, a C5-C6 side stream, and a C7+ hydrotreated naphtha stream. A naphtha splitter overhead stream in line 102 comprising C4– hydrocarbons may be directed to the saturated gas plant unit 110. A naphtha splitter side stream in line 104 comprising C5-C6 hydrocarbons may be fed to a N-paraffin separation unit 50. The naphtha splitter side stream may comprise less than 7 wt % C7+ hydrocarbons, or less than 6 wt % C7+ hydrocarbons, or less than 5 wt % C7+ hydrocarbons.

Figure 2:
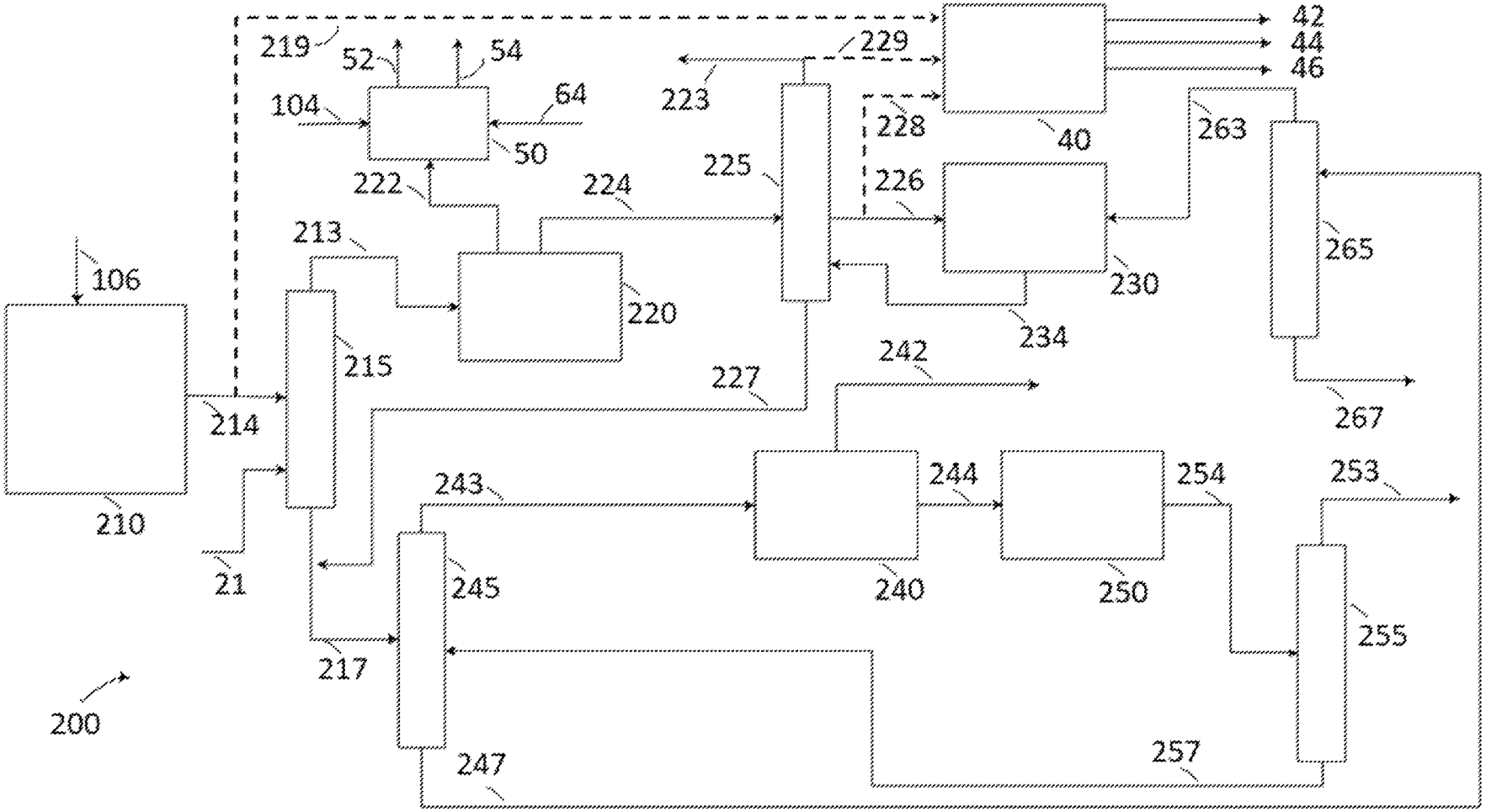
FIG. 2 is a schematic drawing showing details of individual units present within the aromatics complex unit 200 and connectivity to other process units.

The C7+ hydrotreated naphtha stream in line 106 may be fed to an aromatics complex unit 200 for further processing. FIG. 2 shows the aromatic complex unit 200 in greater detail. The C7+ hydrotreated naphtha stream in line 106 may fed to a reforming unit 210.

The reforming unit 210 may carry out the catalytic conversion of paraffins and naphthenes to aromatics over a reforming catalyst. Reforming may be defined as the total effect produced by dehydrogenation of cyclohexanes and dehydroisomerization of alkylcyclopentanes and high carbon content C6 to C7 naphthenes to yield aromatics, dehydrogenation of paraffins to yield olefins, dehydrocyclization of paraffins and olefins to yield aromatics, isomerization of n-paraffins, isomerization of alkylcycloparaffins to yield cyclohexanes, isomerization of substituted aromatics, and hydrocracking of paraffins.

An exemplary catalyst used in reforming unit 210 may comprise one or more Group VIII (IUPAC 8-10) noble metals (e.g., platinum, iridium, rhodium, and palladium) and a halogen combined with a porous carrier, such as a refractory inorganic oxide. Although the catalyst may contain about 0.05 to about 2.0 wt % of Group VIII metal, a less expensive catalyst, such as a catalyst containing about 0.05 to about 0.5 wt % of Group VIII non-noble metal may be used. An exemplary noble metal is platinum. In addition, the catalyst may contain indium and/or a lanthanide series metal such as cerium. The catalyst may also contain about 0.05 to about 0.5 wt % of one or more Group IVA (IUPAC 14) metals (e.g., tin, germanium, and lead). An exemplary halogen is chlorine and an exemplary carrier is alumina. Exemplary alumina materials are gamma, eta, and theta alumina, with gamma and eta alumina generally being used in selected embodiments.

A reforming process may employ a fixed catalyst bed, or a moving bed reaction vessel and a moving bed regeneration vessel. During the course of a reforming reaction with a moving catalyst bed, catalyst particles become deactivated as a result of mechanisms such as the deposition of coke on the particles; that is, after a period of time in use, the ability of catalyst particles to promote reforming reactions decreases to the point that the catalyst is no longer useful. The catalyst can be reconditioned, or regenerated, before it is reused in a reforming process.

The hydrotreated naphtha stream in line 106 may be combined with a hydrogen stream and heated to a temperature of about 427° C. to about 649° C. (about 800° F. to about 1,200° F.), or about 482° C. to about 593° C. (about 900° F. to about 1,100° F.), or about 510° C. to about 566° C. (about 950° F. to about 1,050° F.) for conversion over a reforming catalyst to produce a reformed aromatics stream in line 214. Conditions may include a range of pressures generally from atmospheric pressure of about 0 kPa(g) to about 6,895 kPa(g) (about 0 psig to about 1,000 psig), with particularly good results obtained at the relatively low-pressure range of about 276 kPa(g) to about 1,379 kPa(g) (about 40 psig to about 200 psig). The overall liquid hourly space velocity (LHSV) based on the total catalyst volume in all of the reaction zones is generally about 0.1 $hr^{-1}$ to about 10 hr', such as about 1 hr' to about 5 hr', for example, about 1.5 hr' to about 2.0 $hr^{-1}$.

A reformed aromatics stream in line 214 may be fed to a reformate splitter column 215. The reformed aromatics stream may comprise predominantly aromatics. The reformed aromatics stream may comprise between about 10% and about 90% C6– hydrocarbons or between about 10% and about 90% C7 hydrocarbons or between about 10% and about 90% C8 hydrocarbons. The reformed aromatics stream may further comprise C9 hydrocarbons. In an aspect, a portion of the reformed aromatics stream may optionally be routed in line 219 as feed to the saturation unit 40.

An additional feed to the reformate splitter column 215 may be the hydrotreated pyrolysis gas stream in line 21. The pyrolysis gas stream in line 21 may enter the reformate splitter column 215 at an elevation below the entry point of the reformed aromatics stream in line 214. Thus, the aromatics process unit 200 may be in upstream and downstream communication with the steam cracking unit 10. The reformate splitter column 215 may be operated to produce a light stream which may be a light reformate stream in line 213 comprising C5-C7 hydrocarbons, and a heavy stream which may be a heavy reformate stream in line 217. The overhead pressure in the reformate splitter column may be slightly above atmospheric such as greater than 0 and less than 15 psig or less than 10 psig. The overhead temperature of the reformate splitter column may be between about 90° C. and about 120° C. The light stream may comprise between about 25% and about 75% aromatics and may predominantly comprise C7– hydrocarbons. The light stream may comprise greater than 80% or greater than 90% C7– hydrocarbons. The heavy reformate stream may predominantly comprise C8-C11 aromatic hydrocarbons including xylenes.

The light reformate stream in line 213 may be sent to an aromatics extraction unit 220 to separate aromatic hydrocarbons from non-aromatic hydrocarbons. The aromatics extraction unit 220 can comprise different methods of separating aromatics from a hydrocarbon stream. A preferred method is an extractive distillation process to facilitate high purity extraction of aromatics. Extractive distillation is a technique for separating mixtures of components having nearly equal volatility and having nearly the same boiling point. In extractive distillation, a solvent is introduced into a main extractive-distillation column above the entry point of the hydrocarbon-containing fluid mixture that is to be separated. The solvent affects the volatility of the hydrocarbon-containing fluid component boiling at a higher temperature differently than the hydrocarbon-containing fluid component boiling at a lower temperature sufficiently to facilitate the separation of the various hydrocarbon-containing fluid components by distillation and such solvent exits with the bottoms fraction. Suitable solvents for aromatic extraction may include tetrahydrothiophene 1, 1-dioxide (or sulfolane), NFM (n-formylmorpholine), NMP (n-methylpyrrolidone), diethylene glycol, triethylene glycol, tetraethylene glycol, methoxy triethylene glycol, and mixtures thereof. Other glycol ethers may also be suitable solvents alone or in combination with those listed above.

The aromatic extraction unit 220 may produce a non-aromatic naphtha stream in line 222, and an aromatic naphtha stream in line 224. The non-aromatic naphtha stream may comprise primarily, such as greater than about 80%, greater than about 90%, or greater than about 95%, non-aromatic $C_7^-$ hydrocarbons, and may be fed to the N-paraffin separation unit 50 for further processing.

The aromatic naphtha stream in line 224 may comprise primarily, such as greater than about 80%, greater than about 90%, or greater than about 95%, benzene and toluene and may be fed to a benzene-toluene column 225. The benzene-toluene column 225 may be operated to produce a benzene stream predominantly comprising benzene in line 223, a toluene stream predominantly comprising toluene in line 226 and a C8 aromatics stream comprising C8+ aromatics in line 227. The overhead pressure in the benzene-toluene column may be slightly above atmospheric such as greater than 0 and less than 15 psig or less than 10 psig. The overhead temperature of the benzene-toluene column may be between about 80° C. and about 100° C. The benzene stream may be evacuated from the aromatics process unit 200 for sale, for use in other nearby process units, or alternately, all or a portion may be fed to the to the saturation unit 40 in line 229.

The toluene stream in line 226 may be fed to the transalkylation unit 230 for conversion to C8 aromatics. A portion of the toluene stream may be fed to the saturation unit 40 in line 228. A second feed to the transalkylation unit 230 may comprise the A9 aromatic stream in line 263. The transalkylation unit 230 may catalytically convert feeds comprising toluene and 9 carbon aromatics over a transalkylation catalyst to products rich in xylenes. The transalkylation catalyst may comprise a mordenite (MOR) zeolite, a binder, and a metal. Any mordenite zeolite can be used. Suitable commercially available mordenite zeolites include, but are not limited to, UZM-14 from UOP The binder can be alumina, silica, or combinations thereof. In some embodiments, the binder is alumina. The binder comprises one or more of alumina, silica and silica-alumina. Alumina is an especially preferred refractory inorganic oxide for use herein, particularly with respect to the manufacture of a catalytic composite for use in the transalkylation of alkylaromatic hydrocarbons. The alumina can be those of transitional phases comprising gamma-, theta-, delta-, eta-alumina or high temperature phase such as alpha-alumina, Preferably, alumina is gamma-alumina. The alumina may be incorporated into the catalyst using any of the various hydrous aluminum oxides or alumina gels such as alpha-alumina monohydrate of the boehmite structure, alpha-alumina trihydrate of the gibbsite structure, beta-alumina trihydrate of the bayerite structure, and the like, the first mentioned alpha-alumina monohydrate being preferred.

The metal can be one or more metals from Groups VIB(6) VIIB(7), VIII(8-10) and IVA(14) of the Periodic Table. In some embodiments, the metals are Mo, Ni, Re, Pt, or Pd, or combinations thereof.

Conditions employed in the transalkylation zone may include a temperature of from about 200° C. to about 540° C., preferably between about 200° C. to about 480° C. The transalkylation zone is operated at moderately elevated pressures broadly ranging from about 100 kPa to about 6 MPa absolute. The transalkylation reaction can be effected over a wide range of space velocities, i.e., weight of charge per weight of catalyst per hour, weight hourly space velocity generally is in the range of from about 0.1 to about 20 hr−1.

The transalkylation unit 230 may produce a transalkylated stream rich in C8 aromatics in line 234 which may be fed to the benzene-toluene column 225 at a lower point than the exit of the toluene stream in line 226. The transalkylation unit 230 may be in upstream and downstream communication with the benzene-toluene column 225.

In the saturation reactor or reactors within saturation unit 40, aromatics may be saturated over a bed of saturation catalyst to naphthenes to provide a saturated effluent stream. Feed(s), potentially comprising the reformed aromatics stream in line 219, the benzene stream in line 229, and/or the toluene stream in line 228, to the saturation unit 40 may be heated to about 120° C. (248° F.) to about 230° C. (446° F.) and charged to one or more saturation reactors. The saturation feed may be split to enter multiple reactors to manage the resulting exotherm. Additionally, saturated effluent from the last reactor may be recycled to the first saturation reactor to absorb the heat of reaction. The saturation catalyst in one or more reactors may be the same or different. The saturation catalyst may comprise a noble metal, such as platinum, palladium, a platinum-lithium or nickel on a porous carrier material or any know commercial hydrogenation catalyst.

The porous carrier material may have a surface area of about 25 to about 500 square meters per gram, preferably about 150 to about 225 square meters per gram, and may comprise non-acidic, amorphous alumina. Gamma alumina may be preferred. In addition, a preferred alumina will have an apparent bulk density of about 0.30 to about 0.70 gm/cc and surface area characteristics such that the average pore diameter is about 20 to about 300 Angstroms and the pore volume is about 0.10 to about 1.0 milliliter per gram.

Conditions in the saturation reactor should include a hydrogen to hydrocarbon mole ratio of about 0.01 to about 2, preferably about 0.025 to about 0.5 at the reactor outlet, an outlet reaction temperature of about 240° C. (464° F.) to about 400° C. (752° F.), preferably about 250° C. (482° F.) to about 280° C. (536° F.), a LHSV of about 1 to about 50 $hr^{-1}$, preferably, about 15 to about 25 $hr^{-1}$, and a reactor pressure at the last reactor outlet of 1.4 MPa (200 psig) to about 5.6 MPa (800 psig), preferably about 2.1 MPa (300 psig) to about 3.5 MPa (600 psig). The saturation reactor may be operated in a downflow mode although other reactor configurations and flow regimes may be suitable. One or more product saturate streams exits the saturation unit with a greater concentration of naphthenes and a lower concentration of aromatics than in the feed stream.

The saturation unit 40 may include a saturate fractionation column to produce a plurality of saturate streams. In an exemplary embodiment, the saturate fractionation column may produce a light saturate stream in line 42 rich in C5 saturates and aliphatic C6 saturates which may be transported to the isomerization unit 60 in FIG. 1 to comprise a portion of the isomerization unit 60 feed stream. The light saturate stream may comprise predominantly C5 hydrocarbons. The light saturate stream may comprise greater than 80 wt % C5 hydrocarbons or may comprise greater than 84 wt % C5 hydrocarbons. The isomerization unit 60 may increase the normal paraffin concentration of the light saturate stream in line 42. A heavy saturate stream in line 44 rich in cyclic C6 saturates and C7 and C8 saturates may be recycled and fed to the furnace of the steam cracking unit 10 also in FIG. 1 at one or more entry points to be thermally cracked. The heavy saturate stream may comprise predominantly C6 hydrocarbons or predominantly C6 cycloparaffins. C6 cycloparaffins may be a preferred feed to the steam cracking unit as they produce high yields of butadiene and ethylene during the cracking process. The steam cracking unit 10 may be in upstream and downstream communication with the saturation unit 40. Moreover, the steam cracking unit 10 may be in direct downstream communication with the saturation unit 40. The fractionation column may also produce a heavy fuel stream in a bottoms line 46 that can be sent to fuel oil.

The C8 aromatics stream in line 227 may be combined with the heavy reformate stream in line 217 and fed to a xylene column 245. The xylene column 245 may be operated to produce a xylene stream predominantly comprising 8 carbon aromatics in line 243, and a heavy aromatics stream comprising C9+ aromatics in line 247. The xylene column may comprise a single column or may be a unit comprising multiple columns. The xylene stream may comprise between about 15 wt % and about 30 wt % para-xylene, between about 10% and about 25 wt % ortho-xylene and between about 50% and about 65% meta-xylene. Other C8 aromatic hydrocarbons such as ethylbenzene may also be present in quantities below about 10 wt %.

The xylene stream in line 243 may be fed to a para-xylene separation unit 240. The para-xylene separation unit may comprise any of the known technologies for separation of para-xylene from ortho- and meta-xylenes including fractionation and adsorptive separation. A preferred technology utilizes simulated moving bed (SMB) adsorption process used commercially in a number of large-scale petrochemical separations to recover high purity para-xylene from mixed xylenes. As used herein, "mixed xylenes" refers to a mixture of C8 aromatic isomers that includes ethyl benzene, para-xylene, meta-xylene, and ortho-xylene. High purity para-xylene is used for the production of polyester fibers, resins and films. Para-xylene typically is converted to terephthalic acid or dimethyl terephthalate, which is then reacted with ethylene glycol to form polyethylene terephthalate, the raw material for most polyesters.

The general technique employed in the performance of simulated moving bed adsorptive separation processes is widely described and practiced. Generally, the process simulates a moving bed of adsorbent with continuous countercurrent flow of a liquid feed over the adsorbent. Feed and products enter and leave adsorbent beds continuously, at nearly constant compositions. Separation is accomplished by exploiting the differences in affinity of the adsorbent for para-xylene relative to the other C8 aromatic isomers.

Typical adsorbents used in simulated moving bed adsorption processes generally include crystalline aluminosilicate zeolites and can comprise both the natural and synthetic aluminosilicates. Suitable crystalline aluminosilicate zeolites for use as an adsorbent selective for para-xylene include those having aluminosilicate cage structures in which alumina and silica tetrahedra are intimately connected with each other in an open three-dimensional crystalline network. The tetrahedra are cross linked by the sharing of oxygen atoms, with spaces between the tetrahedra occupied by water molecules prior to partial or total dehydration of the zeolite. The dehydration results in crystals interlaced with channels having molecular dimensions. The exact type aluminosilicate zeolite is generally identified by the particular silica: alumina molar ratio and the pore dimensions of the cage structures.

Cations (M) occupying exchangeable cationic sites in the zeolitic adsorbent may be replaced with other cations by ion exchange methods well known to those having ordinary skill in the field of crystalline aluminosilicates. Crystalline aluminosilicates, such as Zeolite X, a FAU zeolite, with cations at the exchangeable cationic sites within the zeolite, are known to selectively adsorb para-xylene in a mixture comprising at least one other C8 aromatic isomer. The para-xylene separation unit 240 may produce a para-xylene stream predominantly comprising para-xylene in line 242, and a depleted xylene stream in line 244. The para-xylene stream may be evacuated from the aromatics complex unit 200 for sale, or for use in nearby process units. A noted use is as a precursor for preparation of polyethylene terephthalate (PET) and other terephthalate polymers.

The depleted xylene stream in line 244 may be fed to a xylene isomerization unit 250. The xylene isomerization unit isomerizes xylenes from a non-equilibrium composition toward an equilibrium composition. Remaining xylene isomers in the depleted xylene stream may be isomerized to produce the desired isomer (near equilibrium concentration) and convert ethylbenzene (EB) to other components which can be separated via fractionation or other means. The term "isomerization" is used herein to describe the conversion of an aromatic hydrocarbon into at least one different aromatic hydrocarbon product having the same number of carbon atoms. Isomerization desirably converts those aromatics having at least one ethyl, propyl, or butyl substitute, such as ethylbenzene into dimethylbenzene (xylene). One type of xylene isomerization process also isomerizes EB to xylenes via a C8 naphthene intermediate. Another type of xylene isomerization process also dealkylates EB to benzene and ethane.

Isomerization conditions include a temperature range of about 250° C. to about 450° C. and a pressure range of about 3 bar to about 15 bar, using an isomerization catalyst. Isomerization catalyst may comprise a zeolite, a metal function, and a support. The zeolite may comprise, MFI, MEL, MTW, MOR, and/or FER zeotypes. The metal function may comprise platinum. The support may comprise silica, alumina, and/or aluminum phosphate. The xylene isomerization unit 250 may produce an equilibrated xylene stream in line 254 which may be fed to a polishing column 255. Other streams may also be produced. The polishing column may be operated to separate light ends from the C8+ aromatic stream in the equilibrated xylene stream. The overhead pressure in the polishing column may be slightly above atmospheric such as greater than 0 and less than 15 psig or less than 10 psig. The overhead temperature of the polishing column may be between about 90° C. and about 120° C. An aromatic light ends stream may be produced in line 253 and may be routed to the saturated gas plant unit 110. The polishing column may further produce a recycle xylene stream predominantly comprising 8 carbon aromatics in line 257 which may be fed to a middle region of the xylene column 245. The para-xylene separation unit 240 and the xylene isomerization unit 250 may be in upstream and downstream communication with either or both of the xylene column 245 and the polishing column 255.

The heavy aromatics stream in line 247 may be fed to a heavy aromatics column 265. The heavy aromatics column 265 may produce an A9 aromatic stream in line 263 which may be fed to the transalkylation unit 230. The A9 aromatic stream may predominantly comprise 9 carbon aromatic hydrocarbons. The heavy aromatics column 265 may also produce a bottoms stream in line 267. The bottoms stream may comprise $C_{11+}$ aromatic hydrocarbons and may be evacuated from the aromatic process unit 200. In an aspect, all or some of the heavy aromatics bottoms stream may comprise a portion of the feed to the hydrocracking unit 90. Some or all of the heavy aromatics bottoms stream may be sent to a diesel blending system or to a fuel oil system. The overhead pressure in the heavy aromatics column may be slightly above atmospheric such as greater than 0 and less than 15 psig or less than 10 psig. The overhead temperature of the heavy aromatics column may be between about 160° C. and about 200° C.

One, some, or all of the naphtha splitter side stream in line 104, the C5+ isomerate stream in line 64, and the non-aromatic naphtha stream in line 222, may be fed to the N-paraffin separation unit 50 together as a combined feed stream or separately. The naphtha in the N-paraffin separation unit feed stream comprising substantially C4 to C7 hydrocarbons preferably having a T90 between about 40° C. and about 90° C. and suitably no more than about 30 wt % C7+ hydrocarbons may be separated into a normal paraffins stream 52 and a non-normal paraffins stream 54.

The N-paraffin separation unit 50 comprises an adsorption separation unit. The paraffin unit feed stream is passed through a valve in the adsorption separation unit which delivers the feed to an appropriate bed.

Normal paraffins of the naphtha mixture selectively enter or occlude into the porous structure of the adsorbent components but branched or cyclic non-normal chain paraffins do not typically enter the pores. The preferred adsorbent is provided by commercially available type 5A aluminosilicate molecular sieves produced and sold by UOP LLC in Des Plaines, Illinois. The non-normal paraffins exit the process as the non-normal paraffins raffinate stream in line 54. A desorbent is used to desorb the occluded normal paraffins from the adsorbent. Normal nonane or normal decane or even heavier normal paraffin can suitably be used as a desorbent to desorb normal paraffins in an extract-desorbent stream. The adsorption separation unit may comprise a series of vertically spaced, separate beds interconnected by a pipe between the bottom of one bed and the top of its downstream adjacent bed. A valve may comprise a manifold arrangement or a rotary valve for advancing the points of inlet and outlet of respective streams in a downstream direction. The adsorption separation unit may operate in an upflow mode. The adsorbent unit may have four main zones I-IV that may be further subdivided when accounting for different flushing schemes. The number of beds may be eight, twelve or twenty-four beds, divided among the four main zones I-IV. Simulated countercurrent flow is achieved by periodically advancing downstream the introduction point of the feed stream and the desorbent stream while simultaneously and equally advancing downstream the withdrawal point of the raffinate stream and the extract stream. Typical liquid phase operation is preferred in the adsorption separation unit, for example, at temperatures from about 50° C. to about 300° C., and more particularly no more than about 260° C., and pressures from slightly super atmospheric to about 30 atmospheres.

A raffinate stream comprising desorbent and non-normal paraffin raffinate exit the adsorption separation unit together and are fractionated in a raffinate column to provide a raffinate overhead stream comprising non-normal paraffins and a desorbent raffinate bottoms stream. An extract stream comprising desorbent and normal paraffin extract exit the adsorption separation unit together and are fractionated in an extract column to provide an extract overhead stream comprising normal paraffins and a desorbent extract bottoms stream. The raffinate overhead stream rich in non-normal paraffins exit the N-paraffin separation unit process 50 as the raffinate non-normal paraffins raffinate stream in a raffinate line 54 and are fed to an isomerization unit 60. The non-normal paraffins stream in the raffinate line 54 has a predominance of non-normal paraffins which can be isomerized to produce more normal paraffins. In an aspect, two non-normal paraffin streams can be taken from the raffinate column or the non-normal paraffins stream can be fractionated in a subsequent column to provide an isobutane stream and a C5-C7 non-normal paraffins stream. Each stream has a predominance of non-normal paraffins and are fed to the isomerization unit 60 to be isomerized to increase the concentration of normal paraffins.

The extract overhead stream rich in normal paraffins exits the N-paraffin separation unit 50 as the normal paraffins extract stream in an extract line 52. The extract stream from the N-paraffin separation unit 50 rich in normal paraffins in line 52 may be fed to a steam cracking unit 10 to be thermally cracked. The normal paraffins stream in the extract line 52 has a predominance of normal paraffins which makes it an ideal feed for thermal cracking.

In the isomerization unit 60, non-normal hydrocarbons in the non-normal hydrocarbons stream in line 54, in the presence of hydrogen and an isomerization catalyst, are converted to increase the concentration of normal paraffins: ethane, propane, normal butane, normal pentane and normal hexane. Reactions that promote the production of normal paraffins include iso-paraffin disproportionation reactions, ring saturation, opening of aromatics and cyclics, reverse isomerization of iso-paraffins, and paraffin hydrocracking reactions. Thus, a primary product of the isomerization unit 60 is the isomerization product stream in line 64 rich in normal paraffins.

Without being bound by theory, it is believed that the paraffin disproportionation reactions occur by the combination of two iso-paraffins followed by scission into one lighter paraffin and one heavier paraffin. For example, two isopentanes can combine and form an isobutane and an isohexane in the presence of hydrogen. The isobutanes can further react via disproportionation to form a propanes and isopentanes. A portion of the produced isobutanes also converts to normal butanes via isomerization reactions. Production of normal propane and butane via disproportionation and isomerization reactions occurs with low production of low-value undesired methane as a cracked product. Thus, there is an increase in the overall yield of the normal paraffins in the isomerization unit 60. Hydrocracking of the isopentane and/or isohexane can also occur to produce methane, ethane, propane, and isobutane. The isobutane can further react via disproportionation reactions and/or isomerization to further produce normal paraffins.

It may be preferred to isomerize isobutane separately from C5-C7 non-normal hydrocarbons. Hence, an isobutane isomerization reactor may receive the isobutane stream from the paraffin separation unit 50 and a high isomerization reactor may receive the C5-C7 non-normal hydrocarbons stream from the paraffin separation unit.

The isomerization catalyst in the isomerization unit 60 may include chlorided alumina, sulfated zirconia, tungstated zirconia or zeolite-containing isomerization catalysts. The isomerization catalyst may be amorphous, e.g., based upon amorphous alumina, or zeolitic. A zeolitic catalyst would still normally contain an amorphous binder. The catalyst may comprise a sulfated zirconia and platinum as described in U.S. Pat. No. 5,036,035 and EP 0666109 A1 or a platinum group metal on chlorided alumina as described in U.S. Pat. Nos. 5,705,730 and 6,214,764. Another suitable catalyst is described in U.S. Pat. No. 5,922,639. U.S. Pat. No. 6,818,589 discloses a catalyst comprising a tungstated support of an oxide or hydroxide of a Group IVB (IUPAC 4) metal, preferably zirconium oxide or hydroxide, at least a first component which is a lanthanide element and/or yttrium component, and at least a second component being a platinum-group metal component. An advantage of a non-chlorided catalyst, such as a sulfated zirconia catalyst, is the absence of chloride omitting further treatment of the effluent streams from the isomerization unit 60. If chlorided alumina catalyst is used as the isomerization catalyst, a chloriding agent in line will be fed to the isomerization reactor.

The isomerization reaction conditions include an average reactor temperature usually ranging from about 40° to about 250° C. Isomerization reactor operating pressures generally range from 1 MPa (145 psia) to about 5.5 MPa (800 psia) (g). Liquid hourly space velocities (LHSV) range from about 0.2 to about 25 volumes of hydrocarbon feed per hour per volume of catalyst. Hydrogen is admixed with or remains with the isomerization feed to the isomerization reactor. The hydrogen to hydrocarbon feed ratio in the isomerization conditions is from about 0.3 to 2 preferably about 0.5 to about 1.5 and a hydrogen partial pressure of about 1.0 MPa (150 psia) to about 2.4 MPa (350 psia) at the outlet of the reactor in the isomerization unit 60. Higher hydrogen partial pressure in the first isomerization unit 60 is required to maintain stability of the high isomerization catalyst, to saturate and open aromatic and naphthenic rings, to promote hydrocracking reactions and to achieve high conversion to normal paraffins.

Contacting within the isomerization unit 60 may be effected using the isomerization catalyst in a fixed-bed system, a moving-bed system, a fluidized-bed system, or in a batch-type operation. The reactants may be contacted with the bed of isomerization catalyst particles in upward, downward, or radial-flow fashion. The reactants may be in the liquid phase or in a mixed liquid-vapor phase when contacted with the isomerization catalyst particles, with a mixed phase or vapor phase being preferred. The isomerization unit 60 may be in a single reactor or in two or more separate isomerization reactors with suitable means therebetween to ensure that the desired isomerization temperature is maintained at the entrance to each reactor.

The isomerate stream or streams may be fractionated in a depropanizer column to generate a bottoms C5+ isomerate stream increased in its concentration of normal paraffins that can be recycled to the paraffin separation unit 50 in line 64 and a C4− overhead stream that can be fractionated in a deethanizer column to provide an C2 overhead stream, and a bottoms C3-C4 isomerate stream. The C2 stream may be transported to the steam cracking unit 10 in line 66 via line 114, and the C3-C4 isomerate stream may be forwarded in line 62 to a dehydrogenation unit 120 to produce propylene and butene.

The cracked C3-C4 isomerate stream in line 62 may form all or a portion of the feed stream to a dehydrogenation unit 120. The isomerization product stream in line 64 rich in normal paraffins may be recycled to the N-paraffin separation unit 50 as a portion of the feed stream. The isomerization unit 60 and the N-paraffin separation unit 50 may be in upstream and downstream communication with each other. The isomerization unit 60 may produce additional product streams.

An atmospheric bottoms stream in the bottoms line 79 from the crude distillation unit 70 may be fed to a solvent deasphalting unit 80. Broadly, the solvent deasphalting unit may comprise feeding the atmospheric bottoms stream to an extraction zone in which it is contacted with said fresh solvent stream comprising a light paraffin such as propane, butane or pentane. The solvent stream solubilizes lighter materials into a deasphalted oil stream leaving a pitch stream. A deasphalted oil stream in line 82 and a pitch stream in line 84 are recovered from the solvent deasphalting unit 80. A plurality of further operations may be included in the solvent deasphalting unit 80 to further strip solvent from either or both said deasphalted oil stream and the pitch stream for recycle to the process. Further operations may also be included in the solvent deasphalting unit to strip additional deasphalted oil components from the pitch stream and to strip additional pitch components from the deasphalted oil stream.

The pitch stream in line 84 may be utilized as a fuel. The pitch stream may comprise heavy residual oil with high kinematic viscosities often exceeding 3,000 $mm^2/s$ at 100° C. and high contaminant levels of metals and Conradson carbon (Concarbon).

The deasphalted oil stream in line 82 may be fed to a hydrocracking unit 90. The deasphalted oil stream may comprise up to 3 wt % Concarbon. The deasphalted oil stream may comprise less than 3 wppm or less than 2.5 wppm or less than 2 wppm or less than 1 wppm total metals content. Metals may comprise nickel, vanadium, or mixtures of these two metals.

Hydrocracking is a process in which hydrocarbons crack in the presence of hydrogen to lower molecular weight hydrocarbons comprising a hydrocracked product stream. The hydrocracking unit 90 may comprise one or more fixed bed reactor(s) that comprises one or more vessels, single or multiple catalyst beds in each vessel, and various combinations of hydrotreating catalyst and/or hydrocracking catalyst in one or more vessels. Each of the hydrocracking unit feed streams in lines 76, 78, and 82 may be fed to the same reactor or to individual reactors, or to combinations thereof. For example, the hydrocracking unit 90 may include a kerosene hydrocracking unit for hydrocracking the kerosene stream in line 76. The hydrocracking unit 90 may include a distillate hydrocracker for the light gas oil stream in line 78. Moreover, the hydrocracking unit may include a gas oil hydrocracker for the deasphalted oil stream in line 82. Other arrangements or variations such as slurry hydrocracking may be employed.

The hydrocracking unit 90 comprises a plurality of hydrocracking catalyst beds (not shown). If the hydrocracking unit 90 does not comprise a hydrotreating reactor, the catalyst beds in the hydrocracking reactor(s) may include a hydrotreating catalyst for the purpose of saturating, demetallizing, desulfurizing or denitrogenating the hydrocarbon feed stream before it is hydrocracked with the hydrocracking catalyst in subsequent vessels or catalyst beds in the hydrocracking unit. The hydrocarbon feed stream is hydroprocessed over a hydroprocessing catalyst in a hydroprocessing reactor in the presence of a hydrocracking hydrogen stream (not shown) to provide a hydroprocessed effluent stream.

The hydrocracking unit 90 may provide a total conversion of at least about 60 vol % and typically greater than about 70 vol % of the hydrocarbon present in feed streams in lines 76, 78, and 82 to hydrocarbons having no more than seven carbon atoms. A plurality of hydrocracked product streams may be produced by the hydrocracking unit 90. In an embodiment, a preferred product stream is a naphtha hydrocracked stream.

The hydrocracking catalyst may utilize amorphous silica-alumina bases or crystalline zeolite cracking bases upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms. It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms, wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,100,006.

By one approach, the hydrocracking conditions may include a temperature from about 290° C. (550° F.) to about 468° C. (875° F.), preferably 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 0.4 to less than about 2.5 $hr^{1}$ and a hydrogen rate of about 421 $Nm^3/m^3$ (2,500 scf/bbl) to about 2,527 $Nm^3/m^3$ oil (15,000 scf/bbl). The hydrocracking unit 90 is operated at high severity to maximize the conversion to hydrocarbons having seven or less carbon atoms. Normally, hydrocracking units are operated to minimize conversion to hydrocarbons having seven or less hydrocarbons, so as to avoid cracking materials out of the diesel and kerosene distillate range.

The hydrocracking unit 90 may be operated to produce a plurality of product streams. The product streams may comprise an unconverted oil stream in line 99, a distillate hydrocracked stream in line 98, a middle distillate hydrocracked stream in line 96, and one or more naphtha hydrocracked streams in line 94. A portion of, or up to all of, one or more naphtha hydrocracked streams in line 94 may be split in line 95 as feed to the naphtha hydrotreating unit 100 for further processing. Typically, no unconverted oil exits the hydrocracking unit 90. An LPG hydrocracked stream in line 92 may also be produced and fed to a saturated gas plant unit 110. A light gas stream in line 91 may be fed to a PSA unit for hydrogen recovery. The unconverted oil stream may comprise a gasoil range material with low sulfur of 60 wppm or less and/or a Bureau of Mines Correlation Index (BMCI) of greater than 30 but less than 57 consistent with highly naphthenic compositions. The distillate hydrocracked stream in line 98 may comprise less than 10 wppm sulfur and/or a cetane number of greater than 50, greater than 60 or greater than 62. The distillate hydrocracked stream may further comprise a T96 boiling point of 360° C. The middle distillate hydrocracked stream in line 96 may comprise less than 5 wppm or less than 4 wppm sulfur, and/or a smoke point of greater than 31 mm. The middle distillate hydrocracked stream may further comprise an end point of 300° C. The hydrocracked naphtha stream in line 94 may comprise less than 10 volume percent, less than 8 volume percent, or less than 7 volume percent of aromatic molecules. The hydrocracked naphtha stream may further comprise a T95 boiling point of approximately 150° C. The LPG hydrocracked stream in line 92 may comprise greater than 70 wt % C4 hydrocarbons greater than 75 wt % C4 hydrocarbons or greater than 78 wt % C4 hydrocarbons. The LPG hydrocracked stream may comprise greater than 5 wt % and less than 20 wt % C3 hydrocarbons. The LPG hydrocracked stream may further comprise ethane and/or methane. In an exemplary embodiment, one or more of the hydrocracked product streams in lines 94, 96, 98 and 99 may be fed to a steam cracking unit 10 to be thermally cracked. These streams may enter the steam cracking unit at the same point or at separate points which may be strategically located.

One or more cracking feed streams enter a mixed feed steam cracking unit 10 to be fed to the steam cracking furnace for cracking of hydrocarbons under steam to produce a plurality of cracked streams. The cracking feed stream(s) may optionally be in the gas phase. The steam cracking furnace in the mixed feed steam cracking unit 10 may preferably, be operated at a temperature of about 750° C. (1382° F.) to about 950° C. (1742° F.). The cracking feed streams may enter at the same point of the furnace, or at separate points to maximize product yields. A dry gas cracking feed stream, preferably predominantly comprising a stream of ethane, may be fed to the cracking furnace of the steam cracking unit 10. In an embodiment, a saturated gas C2 stream in line 114 from the saturated gas plant 110 comprises this stream. A normal paraffins stream in line 52 may be fed to the cracking furnace of the steam cracking unit 10. One or more hydrocracked streams in lines 94, 96, 98 and/or 99 may be fed to the cracking furnace of the steam cracking unit 10. A heavy saturate stream in line 44 may be fed to the cracking furnace of the steam cracking unit 10.

The cracked stream exiting the furnace of the mixed feed steam cracking unit 10 may be in a superheated state. One or more quench columns, or other devices known in the art, but preferably an oil quench column and/or a water quench column, may be used for quenching or separating the cracked stream into a plurality of cracked streams. The steam cracking unit 10 may further comprise additional distillation columns, amine wash columns, compressors, expanders, etc. to separate the cracked stream into cracked streams rich in individual light olefins.

Among the cracked streams exiting the steam cracking unit 10 may be a methane stream in line 9, an ethylene cracked stream in line 12, a propylene cracked stream in line 14, a butene cracked stream in line 15, a pyrolysis gas stream in line 18, and a fuel oil stream in line 19. The methane stream in line 9 may comprise hydrogen that can be recovered in a pressure swing adsorption unit and the remaining methane used for fuel gas. The ethylene cracked stream in line 12, the propylene cracked stream in line 14 may be recovered or transported to polymerization plants 11 and 13, respectively. The butene cracked stream in line 15 may be recovered and, as with the ethylene and/or propylene stream, used to produce plastics or other petrochemicals by processes such as polymerization.

Product recovery of at least 50 wt %, typically at least 60 wt % and suitably at least 70 wt % of valuable ethylene, propylene, and butylene products is achievable from the steam cracked stream. At lower, more economical carbon-to-diluent gas mole ratios, at least 40 wt % of the products recovered are valuable light olefins. A polymerization plant may be on site, or the recovered olefins may be transported to a polymerization plant for polymer production after further separation to provide polymer grade olefin streams.

The butene cracked stream in line 15 may be processed in one of several ways. The butene cracked stream in line 15 comprises butadiene that can be extracted in a butadiene extraction unit and recovered as a saleable product in line 16. The remaining butene cracked stream can be selectively hydrogenated or in a second alternative the entire butene cracked stream in line 15 can be selectively hydrogenated in a butadiene selective conversion unit 17 to produce butene. Another use for the butene stream may be saturation to butane and recycle to the steam cracking unit 10 as feedstock to be thermally cracked.

The conversion zone within butadiene selective conversion unit 17 may be operated at relatively mild hydrogenation conditions in the liquid phase. A broad range of suitable operating pressures in the butadiene conversion zone range from about 276 kPag (40 psig) to about 5516 kPag (800 psig), or about 345 kPag (50 psig) to about 2069 kPag (300 psig). A relatively moderate temperature between about 25° C. (77° F.) and about 350° C. (662° F.), or about 50° C. (122° F.) to about 200° C. (392° F.) is typically employed. The liquid hourly space velocity (LHSV) of the reactants for the selective hydrogenation catalyst may be above about 1.0 $hr^{-1}$, or above about 10 $hr^{-1}$, or above about 30 $hr^{-1}$, to about 50 $hr^{-1}$. To avoid the undesired saturation of a significant amount mono-olefinic hydrocarbons, the mole ratio of hydrogen to multi-olefinic hydrocarbons in the material entering the bed of selective hydrogenation catalyst may be maintained between 0.75:1 and 1.8:1. A selective hydrogenation catalyst may be used for the butadiene conversion in the butene cracked stream in line 15. A selective hydrogenating catalyst may be any suitable catalyst which is capable of selectively hydrogenating butadiene in a C4 stream may be used in the present disclosure. A particularly preferred selective hydrogenation catalyst comprise copper and at least one other metal such as titanium, vanadium, chrome, manganese, cobalt, nickel, zinc, molybdenum, and cadmium or mixtures thereof. The metals are preferably supported on inorganic oxide supports such as silica and alumina. Preferably, a selective hydrogenation catalyst may comprise a copper and a nickel metal supported on alumina.

The pyrolysis gas stream in line 18 may comprise a C4+ hydrocarbon stream or a C5+ hydrocarbon stream or a C6+ hydrocarbon stream comprising aromatics, naphthenes, and pyrolyzed gasoline.

At least a portion or all of the pyrolysis gas stream in line 18 may be passed directly to a pyrolysis hydrotreating unit 20 to produce a hydrotreated pyrolysis gas stream in line 21.

The pyrolysis gas stream in line 18 may be subjected to selective hydrogenation to convert diolefins and conjugated-diolefins to monoolefins. A hydrogen stream may be added to the pyrolysis gas stream in line 18 and charged to a pyrolysis hydrotreating unit 20. Hydrotreating can be performed at high or low pressures but is typically and preferably performed at a lower pressure. The reactants will normally be maintained under the minimum pressure sufficient to maintain the reactants as liquid phase hydrocarbons. A broad range of suitable operating pressures therefore extends from about 276 kPa(g) (40 psig) to about 34.6 MPag (5000 psig), or about 3795 kPa(g) (550 psig) to 20.8 MPag (3000 psig), or about 5516 kPa(g) (800 psig) to about 7 MPag (1000 psig). A temperature between about 25° C. (77° F.) and about 482° C. (900° F.), or from about 50° C. (122° F.) to to about 464° C. (850° F.), or from about 150° C. (302° F.) to about 350° C. (662° F.) is typically employed. The liquid hourly space velocity of the reactants through the hydrotreating catalyst should be between about 0.3 $hr^{-1}$ and about 35.0 $hr^{-1}$, or from about 0.5 $hr^{-1}$ to about 20 $hr^{-1}$ (v/v) preferably from about 1.0 hr' to about 4.0 hr'.

Any suitable catalyst which is capable of selectively hydrogenating diolefins and/or hydrogenating aromatics in a naphtha stream may be used. Suitable hydrotreating catalyst may comprise any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Phosphorous may also be incorporated into the catalyst. Other suitable hydrotreating catalysts include zeolitic catalysts. More than one type of first hydrotreating catalyst may be used. The Group VIII metal may typically be present in an amount ranging from about 2 to about 20 wt %, preferably from about 4 to about 12 wt %. The Group VI metal may typically be present in an amount ranging from about 1 to about 25 wt %, preferably from about 2 to about 25 wt %.

The pyrolysis hydrotreating unit 20 may produce a hydrotreated pyrolysis gas stream in line 21. The hydrotreated pyrolysis gas stream may be fed to the aromatics process unit 200, specifically to the reformate splitter column 215 in FIG. 2. Thus, the pyrolysis hydrotreating unit 20 may be in upstream and downstream communication with the steam cracking unit 10 and the aromatics process unit 200.

SPECIFIC EMBODIMENTS

While the following is described in conjunction with specific embodiments, it will be understood that this description is intended to illustrate and not limit the scope of the preceding description and the appended claims.

A first embodiment of the invention is a process for producing light olefins and aromatics comprising thermally cracking a cracking feed stream to provide a cracked stream; separating a pyrolysis gas stream from the cracked stream; separating the pyrolysis gas stream into a light stream and a heavy stream; and separating the light stream into a non-aromatic naphtha stream and an aromatic naphtha stream. An embodiment of the invention is one, any or all of prior embodiments in this paragraph up through the first embodiment in this paragraph further comprising separating the non-aromatic naphtha stream into a normal paraffins stream and a non-normal paraffins stream. An embodiment of the invention is one, any or all of prior embodiments in this paragraph up through the first embodiment in this paragraph further comprising thermally cracking the normal paraffins stream. An embodiment of the invention is one, any or all of prior embodiments in this paragraph up through the first embodiment in this paragraph further comprising isomerizing the non-normal paraffin stream to normal paraffins. An embodiment of the invention is one, any or all of prior embodiments in this paragraph up through the first embodiment in this paragraph further comprising separating the aromatic naphtha stream into a benzene stream and a C8 aromatics stream. An embodiment of the invention is one, any or all of prior embodiments in this paragraph up through the first embodiment in this paragraph further comprising hydrotreating the pyrolysis gas stream. An embodiment of the invention is one, any or all of prior embodiments in this paragraph up through the first embodiment in this paragraph further comprising saturating the aromatic naphtha stream to produce a product saturate stream and separating the product saturate stream into a heavy saturate stream and a light saturate stream. An embodiment of the invention is one, any or all of prior embodiments in this paragraph up through the first embodiment in this paragraph further comprising isomerizing the light saturate stream to increase its normal paraffin concentration. An embodiment of the invention is one, any or all of prior embodiments in this paragraph up through the first embodiment in this paragraph further comprising hydrocracking a distillate stream from a crude distillation unit and/or a deasphalted oil stream to produce the cracking feed stream. An embodiment of the invention is one, any or all of prior embodiments in this paragraph up through the first embodiment in this paragraph wherein the distillate stream may be a gas oil distillate stream or a middle distillate stream. An embodiment of the invention is one, any or all of prior embodiments in this paragraph up through the first embodiment in this paragraph further comprising hydrotreating a naphtha stream from the hydrocracking step and separating normal paraffins from non-normal paraffins in the naphtha stream.

A second embodiment of the invention is a process for producing light olefins and aromatics comprising hydrocracking a distillate stream from a crude distillation unit to produce a hydrocracked stream; thermally cracking the hydrocracked stream to provide a pyrolysis gas stream; and separating the pyrolysis gas stream into a non-aromatic naphtha stream and an aromatic naphtha stream. An embodiment of the invention is one, any or all of prior embodiments in this paragraph up through the second embodiment in this paragraph further comprising separating the pyrolysis gas stream into a light stream and a heavy stream; and separating the light stream into the non-aromatic naphtha stream and the aromatic naphtha stream. An embodiment of the invention is one, any or all of prior embodiments in this paragraph up through the second embodiment in this paragraph further comprising separating the non-aromatic naphtha stream into a normal paraffins stream and a non-normal paraffins stream and thermally cracking the normal paraffins stream and isomerizing the non-normal paraffins stream. An embodiment of the invention is one, any or all of prior embodiments in this paragraph up through the second embodiment in this paragraph further comprising separating the aromatic naphtha stream into a toluene stream and a C8 aromatics stream; and separating the C8 aromatics stream into a xylene stream and a heavy aromatics stream. An embodiment of the invention is one, any or all of prior embodiments in this paragraph up through the second embodiment in this paragraph further comprising transalkylating the toluene stream and the heavy aromatics stream to form a transalkylated stream; and separating the transalkylated stream into the toluene stream and the C8 aromatics stream.

A third embodiment of the invention is a process for producing light olefins and aromatics comprising thermally cracking a cracking feed stream to provide a cracked stream; separating a pyrolysis gas stream from the cracked stream; reforming a naphtha stream to produce a reformed aromatics stream; and separating the pyrolysis gas stream and the reformed aromatics stream into a non-aromatic naphtha stream and an aromatic naphtha stream. An embodiment of the invention is one, any or all of prior embodiments in this paragraph up through the third embodiment in this paragraph further comprising hydrocracking a distillate stream from a crude distillation unit to produce the naphtha stream. An embodiment of the invention is one, any or all of prior embodiments in this paragraph up through the third embodiment in this paragraph further comprising saturating the aromatic naphtha stream to produce a product saturate stream and separating the product saturate stream into a heavy saturate stream and a light saturate stream. An embodiment of the invention is one, any or all of prior embodiments in this paragraph up through the third embodiment in this paragraph further comprising thermally cracking the heavy saturate stream and isomerizing the light saturate stream to increase its normal paraffin concentration.

Without further elaboration, it is believed that using the preceding description that one skilled in the art can utilize the present disclosure to its fullest extent and easily ascertain the essential characteristics of this disclosure, without departing from the spirit and scope thereof, to make various changes and modifications of the disclosure and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for producing light olefins and aromatics comprising:

thermally cracking a cracking feed stream to provide a cracked stream;

separating a pyrolysis gas stream from said cracked stream;

separating said pyrolysis gas stream into a light stream and a heavy stream; and separating said light stream into a non-aromatic naphtha stream and an aromatic naphtha stream; and separating said non-aromatic naphtha stream into a normal paraffins stream and a non-normal paraffins stream.

2. The process of claim 1 further comprising thermally cracking said normal paraffins stream.

3. The process of claim 1 further comprising isomerizing said non-normal paraffin stream to normal paraffins.

4. The process of claim 1 further comprising separating said aromatic naphtha stream into a benzene stream and a C8 aromatics stream.

5. The process of claim 1 further comprising hydrotreating said pyrolysis gas stream.

6. The process of claim 1 further comprising saturating said aromatic naphtha stream to produce a product saturate stream and separating said product saturate stream into a heavy saturate stream and a light saturate stream.

7. The process of claim 6 further comprising isomerizing said light saturate stream to increase its normal paraffin concentration.

8. The process of claim 1 further comprising hydrocracking a distillate stream from a crude distillation unit and/or a deasphalted oil stream to produce said cracking feed stream.

9. The process of claim 8 wherein said distillate stream may be a gas oil distillate stream or a middle distillate stream.

10. The process of claim 9 further comprising hydrotreating a naphtha stream from said hydrocracking step and separating normal paraffins from non-normal paraffins in said naphtha stream.

11. A process for producing light olefins and aromatics comprising:

hydrocracking a distillate stream from a crude distillation unit to produce a hydrocracked stream;

thermally cracking said hydrocracked stream to provide a pyrolysis gas stream;

separating said pyrolysis gas stream into a non-aromatic naphtha stream and an aromatic naphtha stream; and separating said non-aromatic naphtha stream into a normal paraffins stream and a non-normal paraffins stream.

12. The process of claim 11 further comprising separating said pyrolysis gas stream into a light stream and a heavy stream; and separating said light stream into said non-aromatic naphtha stream and said aromatic naphtha stream.

13. The process of claim 12 further comprising separating said non-aromatic naphtha stream into a normal paraffins stream and a non-normal paraffins stream and thermally cracking said normal paraffins stream and isomerizing said non-normal paraffins stream.

14. The process of claim 11 further comprising separating said aromatic naphtha stream into a toluene stream and a C8 aromatics stream; and separating said C8 aromatics stream into a xylene stream and a heavy aromatics stream.

15. The process of claim 14 further comprising transalkylating said toluene stream and said heavy aromatics stream to form a transalkylated stream; and separating said transalkylated stream into said toluene stream and said C8 aromatics stream.

16. A process for producing light olefins and aromatics comprising:

thermally cracking a cracking feed stream to provide a cracked stream;

separating a pyrolysis gas stream from said cracked stream;

reforming a naphtha stream to produce a reformed aromatics stream;

separating said pyrolysis gas stream and said reformed aromatics stream into a non-aromatic naphtha stream and an aromatic naphtha stream; and separating said non-aromatic naphtha stream into a normal paraffins stream and a non-normal paraffins stream.

17. The process of claim 16 further comprising hydrocracking a distillate stream from a crude distillation unit to produce said naphtha stream.

18. The process of claim 16 further comprising saturating said aromatic naphtha stream to produce a product saturate stream and separating said product saturate stream into a heavy saturate stream and a light saturate stream.

19. The process of claim 18 further comprising thermally cracking said heavy saturate stream and isomerizing said light saturate stream to increase its normal paraffin concentration.

* * * * *